US009506705B1

(12) United States Patent
Fleischli

(10) Patent No.: US 9,506,705 B1
(45) Date of Patent: Nov. 29, 2016

(54) FEEDER DELINKER

(71) Applicant: Joseph H. Fleischli, Springfield, IL (US)

(72) Inventor: Joseph H. Fleischli, Springfield, IL (US)

( * ) Notice: Subject to any disclaimer, the term of this patent is extended or adjusted under 35 U.S.C. 154(b) by 0 days.

(21) Appl. No.: 15/132,290

(22) Filed: Apr. 19, 2016

Related U.S. Application Data

(60) Provisional application No. 62/150,378, filed on Apr. 21, 2015.

(51) Int. Cl.

| | |
|---|---|
| ***F41A 9/00*** | (2006.01) |
| ***F41A 9/36*** | (2006.01) |
| ***F41F 1/10*** | (2006.01) |
| ***F41A 9/31*** | (2006.01) |

(52) U.S. Cl.
CPC .. *F41A 9/36* (2013.01); *F41A 9/31* (2013.01); *F41F 1/10* (2013.01)

(58) Field of Classification Search
CPC ..... F41A 9/31; F41A 9/36; F41F 1/10
See application file for complete search history.

(56) References Cited

U.S. PATENT DOCUMENTS

| | | | | |
|---|---|---|---|---|
| 2,789,474 | A * | 4/1957 | Darsie | F41A 9/31 89/33.25 |
| 3,229,584 | A * | 1/1966 | Zehuder | F41A 9/30 89/33.25 |
| 3,333,506 | A | 8/1967 | Henshaw et al. | |
| 4,397,216 | A * | 8/1983 | Tassie | F41A 9/31 89/33.04 |
| 4,506,588 | A * | 3/1985 | Kazanjy | F41A 9/82 89/33.25 |
| 4,658,701 | A * | 4/1987 | Moore | F41A 9/31 89/33.2 |
| 6,443,044 | B1 | 9/2002 | Dillon | |
| 7,971,515 | B2 | 7/2011 | Garwood | |
| 8,006,603 | B2 | 8/2011 | Gardwood | |
| 8,607,683 | B1 * | 12/2013 | Burgermeister | F41A 9/31 89/33.16 |
| 2016/0123686 | A1 * | 5/2016 | Rowe | F41A 9/31 89/33.25 |

* cited by examiner

*Primary Examiner* — Gabriel Klein
(74) *Attorney, Agent, or Firm* — Philip L. Bateman

(57) ABSTRACT

A feeder delinker for a Gatling-type machine gun accepts an ammunition belt consisting of interconnecting rounds and clips. The feeder delinker contains a paddlewheel that separates the leading round from the leading clip by applying a side force directly to the round between the two C-shaped loops while the clip is restrained.

4 Claims, 7 Drawing Sheets

FEEDER DELINKER

CROSS-REFERENCE TO RELATED APPLICATION

This application claims the benefit of U.S. Provisional Application Ser. No. 62/150,378, Apr. 21, 2015.

FIELD OF THE INVENTION

This invention relates to military weapons and ammunition, commonly known as ordnance. More particularly, this invention relates to feeder delinkers for Gatling-type machine guns.

BACKGROUND OF THE INVENTION

In the early 1860s, Richard Gatling of the United States invented a hand-cranked machine gun having multiple rotating barrels that fired sequentially. The gun came to be known as the Gatling gun and was used by the U.S. Army and the armies of many other countries. The hand-cranking feature was later replaced by an electric motor.

One hundred years after the Gatling gun was invented, a six-barreled Gatling-type machine gun was developed by the General Electric Company that could fire 5,000 or more rounds per minute. The new gun came to be known as the M134 Minigun. The Minigun was widely used in by the U.S. military in the Vietnam War and is still in use today. A Minigun G is shown in FIG. 1.

The Minigun fires 7.62 mm rounds (also known as cartridges) that are fed in the form of a belt formed of interconnecting clips and rounds. FIG. 2 shows a round R and two clips C. FIG. 3 shows an ammunition belt made up of three rounds and three clips. Each clip has two coaxial and spaced apart C-shaped leading loops that hold the same round. Each clip also has a third C-shaped trailing loop that is on a different axis and holds a different round. The lateral direction of travel of the ammunition belt is indicated by the large arrow in FIG. 3. The terms "leading" and "trailing" are used herein in reference to this lateral direction of travel.

A feeder delinker is the component of the Minigun that receives the belt, separates (strips) the leading round from the leading clip, separates the clip from the belt, ejects the clip, and feeds the round to the rotary firing chamber of the Minigun. The feeder delinker is mounted underneath the Minigun and is powered by the same power source as the Minigun. The Minigun cannot fire without an operating feeder delinker.

The original feeder delinker for the Minigun separates the round from the clip by pushing the round forward axially with a reciprocating pushrod. The original feeder delinker has a large number of moving parts that require precise alignment. As a result, the original feeder delinker is prone to breakage and malfunction, especially under adverse conditions. Repairs to the original feeder delinker are often time consuming because the unit must be substantially disassembled.

Improvements to the original Minigun feeder delinker are disclosed in Dillon, U.S. Pat. No. 6,443,044, Sep. 3, 2002; Garwood, U.S. Pat. No. 7,971,515, Jul. 5, 2011; and Garwood, U.S. Pat. No. 8,006,603, Aug. 30, 2011. The Dillon feeder delinker contains two access doors that reduce repair time. The Garwood feeder linker contains a single access door with a plunger. Like the original feeder delinker, the Dillon and Garwood feeder delinkers contain reciprocating pushrods to separate a round from the clip.

Henshaw et al., U.S. Pat. No. 3,333,506, Aug. 1, 1967, disclose a Minigun feeder delinker that separates a round from the clip from the side (laterally) rather than pushing it forward (axially). The Henshaw et al. side stripping feeder delinker restrains the round on two flanges of a freely rotatable spool while a tooth of a rotating sprocket pushes the link off the round. The Henshaw et al. feeder delinker requires precise alignment and is prone to malfunction. More particularly, the two flanges must contact the round outwardly of the two C-shaped forward loops of the clip. If the round is slightly forward or slightly rearward, the flanges do not make the required contact and the feeder delinker malfunctions.

Accordingly, there is a demand for an improved feeder delinker that has fewer moving parts, is more reliable (less prone to malfunction), is more durable (less prone to breakage), and is less expensive to manufacture.

SUMMARY OF THE INVENTION

The general objects of this invention are to provide an improved feeder delinker for a Gatling-type machine gun and to provide an improved method for separating a leading round from a leading clip in a feeder delinker for a Gatling-type machine gun.

I have invented an improved feeder delinker for accepting an ammunition belt consisting of interconnecting rounds and clips, separating the leading round from the leading clip, and feeding the separated rounds to a Gatling-type machine gun having a rotary firing chamber and a drive gear. The feeder delinker comprises: (a) a housing; (b) a primary rotatable shaft assembly; (c) a secondary rotatable shaft assembly; (d) a paddlewheel; (e) a lower stripper; and (f) an upper stripper.

The housing has: (i) a bracket for attachment to a Gatling-type machine gun; (ii) a primary sleeve for accepting a primary rotatable shaft; (iii) a secondary sleeve for accepting a secondary rotatable shaft; (iv) an inlet for accepting an ammunition belt consisting of interconnecting rounds and clips; (v) a first outlet for separated rounds adapted to communicate with a rotary firing chamber of a Gatling-type machine gun; and (vi) a second outlet for separated clips. The primary rotatable shaft assembly in the primary sleeve of the housing has: (i) a primary rotatable shaft; (ii) a driven spur gear on the primary shaft engaging the drive gear of a Gatling-type machine gun; and (iii) a timing spur gear on the primary shaft. The secondary rotatable shaft assembly in the secondary sleeve of the housing has: (i) a secondary rotatable shaft; (ii) a driven spur gear on the secondary shaft engaging the timing spur gear of the primary shaft; (iii) a front sprocket on the secondary shaft that engages the front of the leading round in an ammunition belt; and (iv) a rear sprocket on the secondary shaft that engages the rear of the leading round in an ammunition belt.

The paddlewheel is mounted on the secondary rotatable shaft. The paddlewheel has a plurality of radial paddles for applying a side force to the leading round in the ammunition belt sufficient to strip the round from the restrained clip, each paddle having a leading outer edge for engaging the leading clip and having a trailing block for engaging the leading round. The lower stripper has: (i) a shelf for supporting and restraining the leading round and the leading clip in the ammunition belt; (ii) a curved surface coaxial with the secondary rotatable shaft for guiding the separated round; and (iii) a slot communicating with the second outlet of the housing for the discharge of the separated clip. The upper stripper has: (i) a bracket overhanging the shelf of the lower stripper; (ii) a front cam connected to the bracket for guiding the front of the separated round; and (iii) a rear cam connected to the bracket for guiding the rear of the separated round. In operation with a Gatling-type machine gun, each radial paddle strips a leading round from a leading clip and then transports the separated round to the first outlet.

I have also invented an improved method for separating a leading round from a leading clip in a feeder delinker for a Gatling-type machine gun. The method comprises applying a side force with a rotating paddlewheel directly to the round while restraining the clip.

The feeder delinker of this invention has fewer moving parts, is more reliable, is more durable, and is less expensive to manufacture.

DETAILED DESCRIPTION OF THE INVENTION

1. The Feeder Delinker In General

Figure 1:
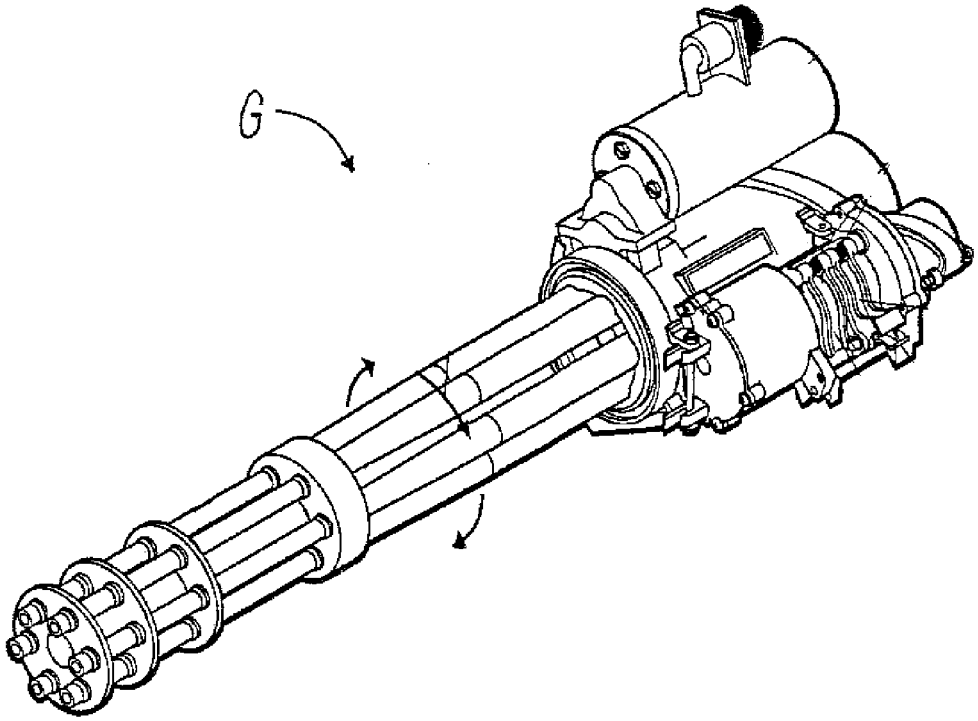
FIG. 1 (PRIOR ART)
FIG. 1 is a perspective view of a prior art Gatling-type machine gun.
Figure 2:
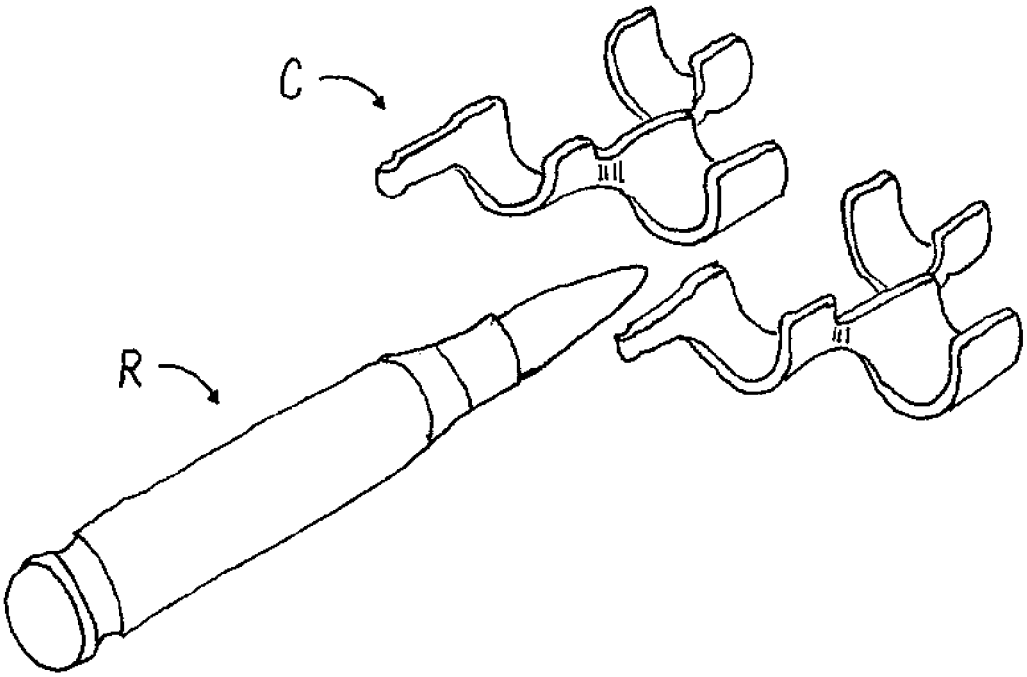
FIG. 2 (PRIOR ART)
FIG. 2 is a perspective view of a prior art round and two clips.
Figure 3:
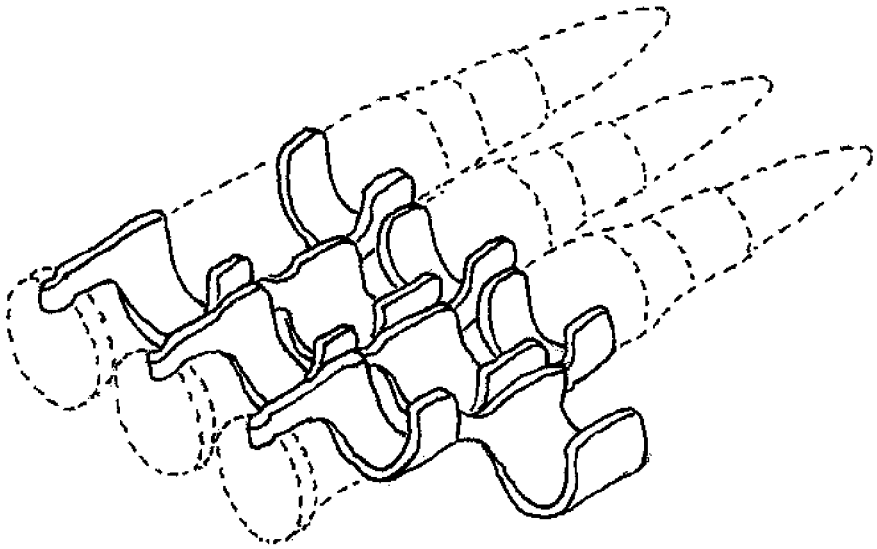
FIG. 3 (PRIOR ART)
FIG. 3 is a perspective view of a prior art ammunition belt comprising three rounds and three clips.
Figure 4:
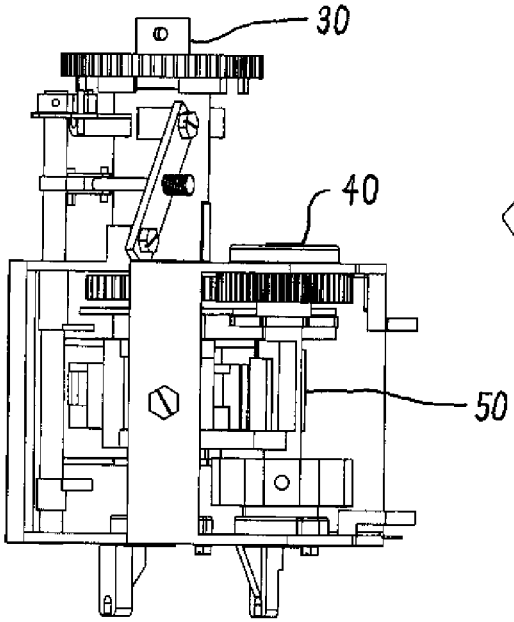
FIG. 4 is a bottom plan view of a preferred embodiment of the feeder delinker of this invention.
Figure 5:
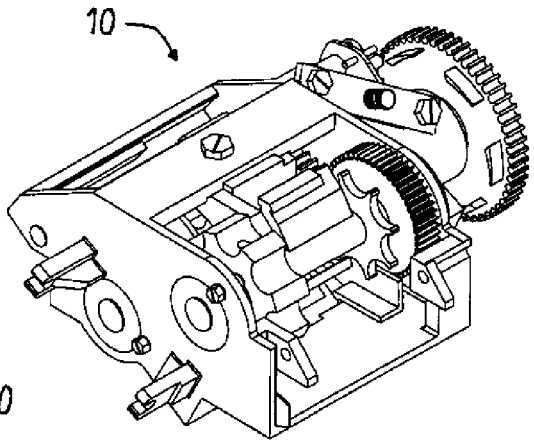
FIG. 5 is perspective view thereof.
Figure 6:
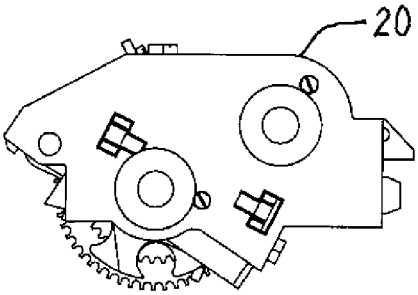
FIG. 6 is a front elevation view thereof.
Figure 7:
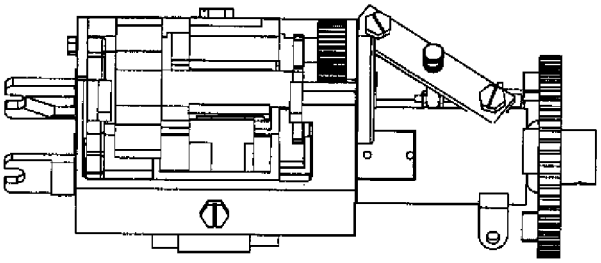
FIG. 7 is a side elevation view thereof.
Figure 8:
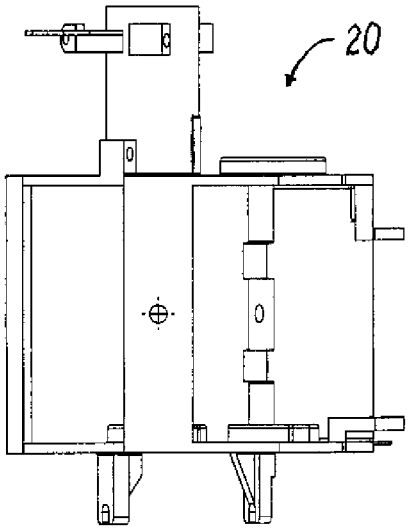
FIG. 8 is a bottom plan view of the housing thereof.
Figure 9:
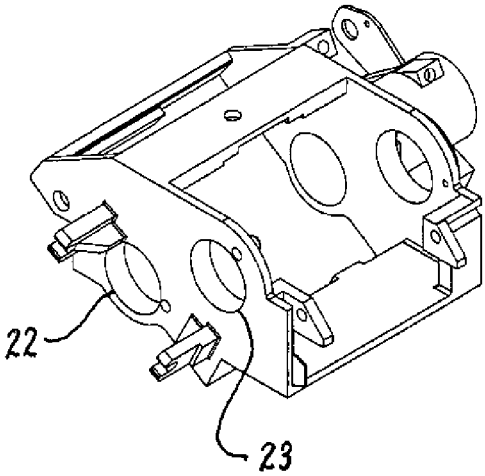
FIG. 9 is perspective view thereof.
Figure 10:
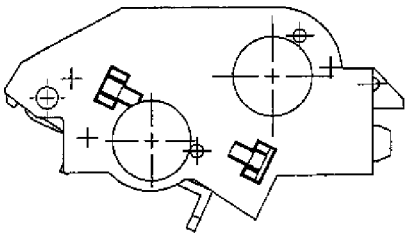
FIG. 10 is a front elevation view thereof.
Figure 11:
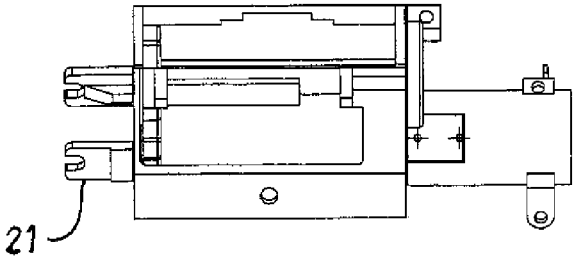
FIG. 11 is a side elevation view thereof.
Figure 12:
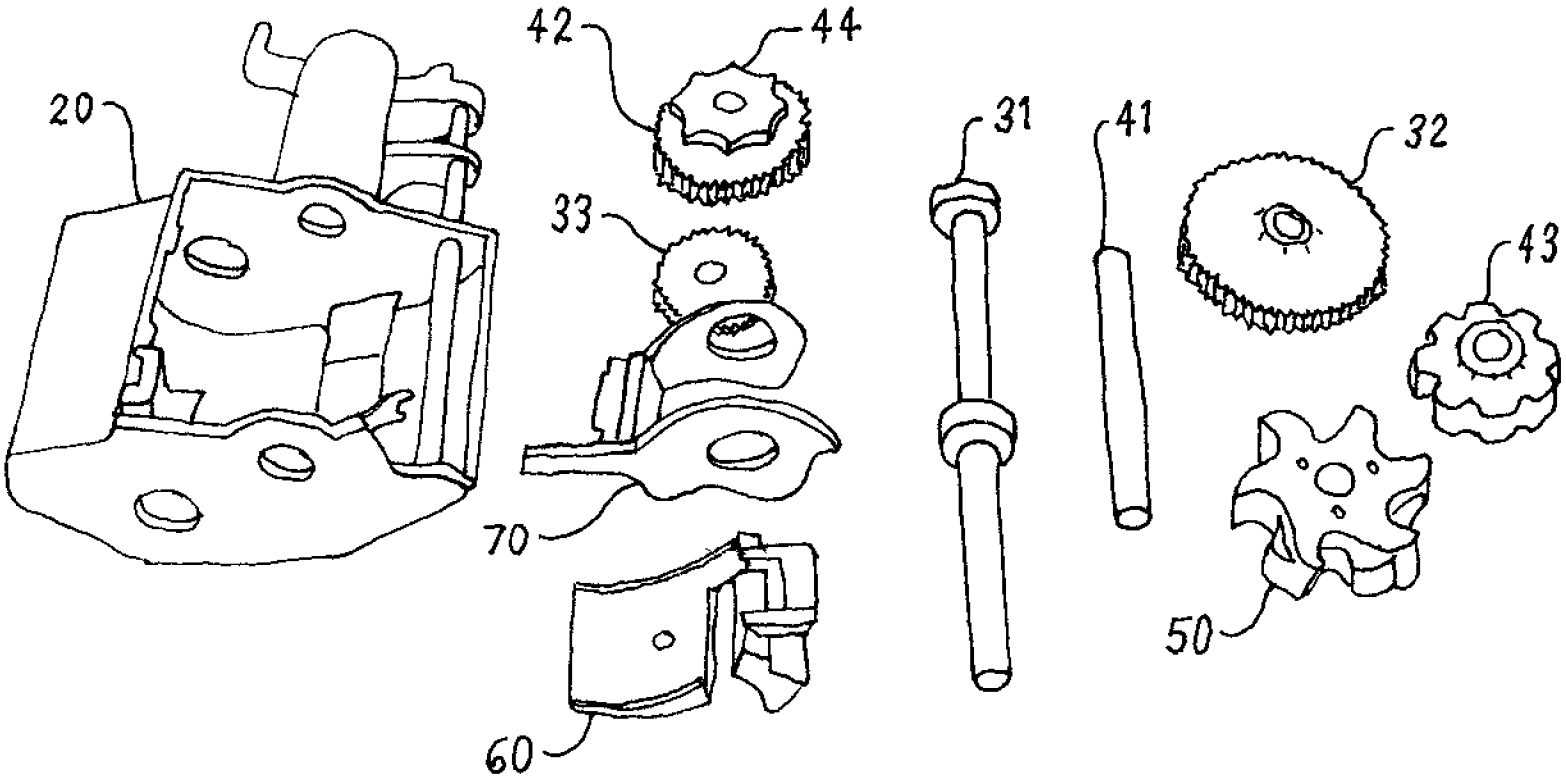
FIG. 12 is a perspective exploded view of all components.

This invention is best understood by reference to the drawings. Referring first to FIGS. 4 to 7 and 12, a preferred embodiment of the feeder delinker 10 of this invention comprises a housing 20, a primary rotatable shaft assembly 30, a secondary rotatable shaft assembly 40, a paddlewheel 50, a lower stripper 60, and an upper stripper 70. In FIG. 4, the feeder delinker is shown from the bottom as it would appear before being raised to connect to the underside of a Gatling-type machine gun. The term "Gatling-type machine gun" is used herein to refer to a machine gun having rotating barrels that fire sequentially. An ammunition belt consisting of four rounds R and four clips C is shown in the orientation and position it would have when about to be fed into the feeder delinker. The terms "front" and "forward" are used herein in reference to the direction in which a round faces and in which the bullet travels when fired. Upon entry into the feeder delinker, the leading round and leading clip are restrained momentarily before the leading round is separated from the leading clip by the paddlewheel. The separated round is then fed into the rotary firing chamber of the gun and the separated clip is discharged. The components of the feeder delinker are discussed in detail below.

2. The Housing

Referring now to FIGS. 8 to 11, the housing 20 has brackets 21 for fast and easy attachment to the bottom of a Gatling-type machine gun with a pin. The brackets are conventional. The housing also has a first sleeve 22 for accepting a primary rotatable shaft and a second sleeve 23 for accepting a secondary rotatable shaft. The housing further has an inlet for accepting an ammunition belt consisting of interconnecting rounds and clips, a first outlet for the separated rounds that communicates with a rotary firing chamber of the gun, and a second outlet for discharging the separated clips. The housing is preferably made of hardened steel. All the components of the feeder delinker are preferably made of hardened steel except as noted.

3. The Primary Rotatable Shaft Assembly

The primary rotatable shaft assembly 30 includes a primary shaft 31 and a driven rotor spur gear 32 on the shaft that is engaged by the rotor spur gear of the gun. The assembly also has a timing spur gear 33 on the shaft that engages the second rotatable shaft assembly.

4. The Secondary Rotatable Shaft Assembly

The secondary rotatable shaft assembly 40 includes a secondary shaft 41 and a driven spur gear 42 on the secondary shaft that is driven by the timing spur gear of the primary rotatable shaft assembly. The assembly also includes a front sprocket 43 and a rear sprocket 44, each of which has nine teeth in the preferred embodiment. The front sprocket engages the front (nose) of the leading round and the rear sprocket engages the rear (head) of the leading round as it is fed toward the paddlewheel. In the preferred embodiment, the rear sprocket is integral with the driven spur gear. In the preferred embodiment, the front sprocket is made of a hard and durable plastic such as nylon or the like. The secondary rotatable shaft rotates at a speed that ensures that rounds are fed into the feeder delinker at exactly the same rate as rounds are being fired by the gun.

5. The Paddlewheel

Figure 13:
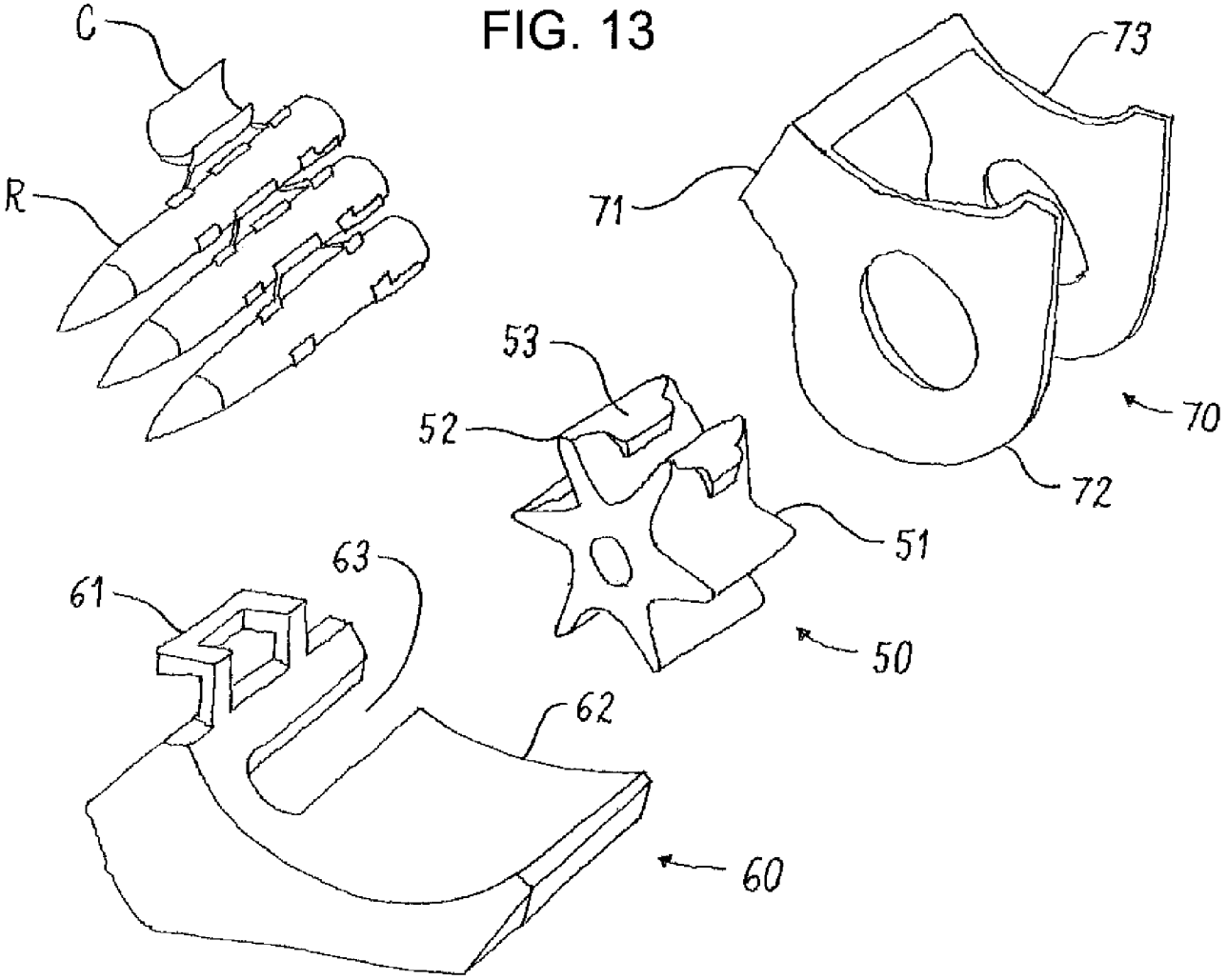
FIG. 13 is a perspective exploded view of selected components.

The paddlewheel 50 is mounted on the secondary rotatable shaft. Referring now to FIG. 13, the paddlewheel has six radial paddles 51 that sequentially strip rounds from the clips. The paddles then convey the separated round along the lower stripper and up into the rotary firing chamber of the gun. Each paddle has a leading outer edge 52 that extends across the entire width of the paddle for engaging both of the leading C-shaped loops of the leading clip. Each paddle has a trailing block 53 that is narrower than the leading surface. The trailing block engages the leading round between the C-shaped loops of the clip. As explained in more detail below, the leading edge of the paddle holds the clip while the trailing block of the paddle forces the round off the clip.

6. The Lower Stripper

The lower stripper 60 has a shelf (platform) 61 that supports the leading round and the leading clip of the ammunition belt as they enter the feeder stripper. The leading clip drops into the recess of the shelf while the leading round remains on top of the shelf momentarily before being contacted by the paddlewheel. The lower stripper also has a curved surface 62 that is coaxial with the secondary rotatable shaft. The stripped round is conveyed by the paddle of the paddlewheel along the curved surface on its way to the rotary firing chamber of the gun. The lower stripper also has a slot 63 for the immediate discharge of the separated clip. The slot communicates with the second outlet of the housing.

7. The Upper Stripper

The upper stripper 70 has an upper bracket 71 that is attached to the housing. The upper stripper has two spaced apart cams connected to the bracket that guide a separated round radially outward as it moves upward toward the rotary firing chamber of the gun. The front cam 72 engages the front (nose) of the separated round and the rear cam 73 engages the rear (head) of the separated round.

8. Operation

Figure 14:
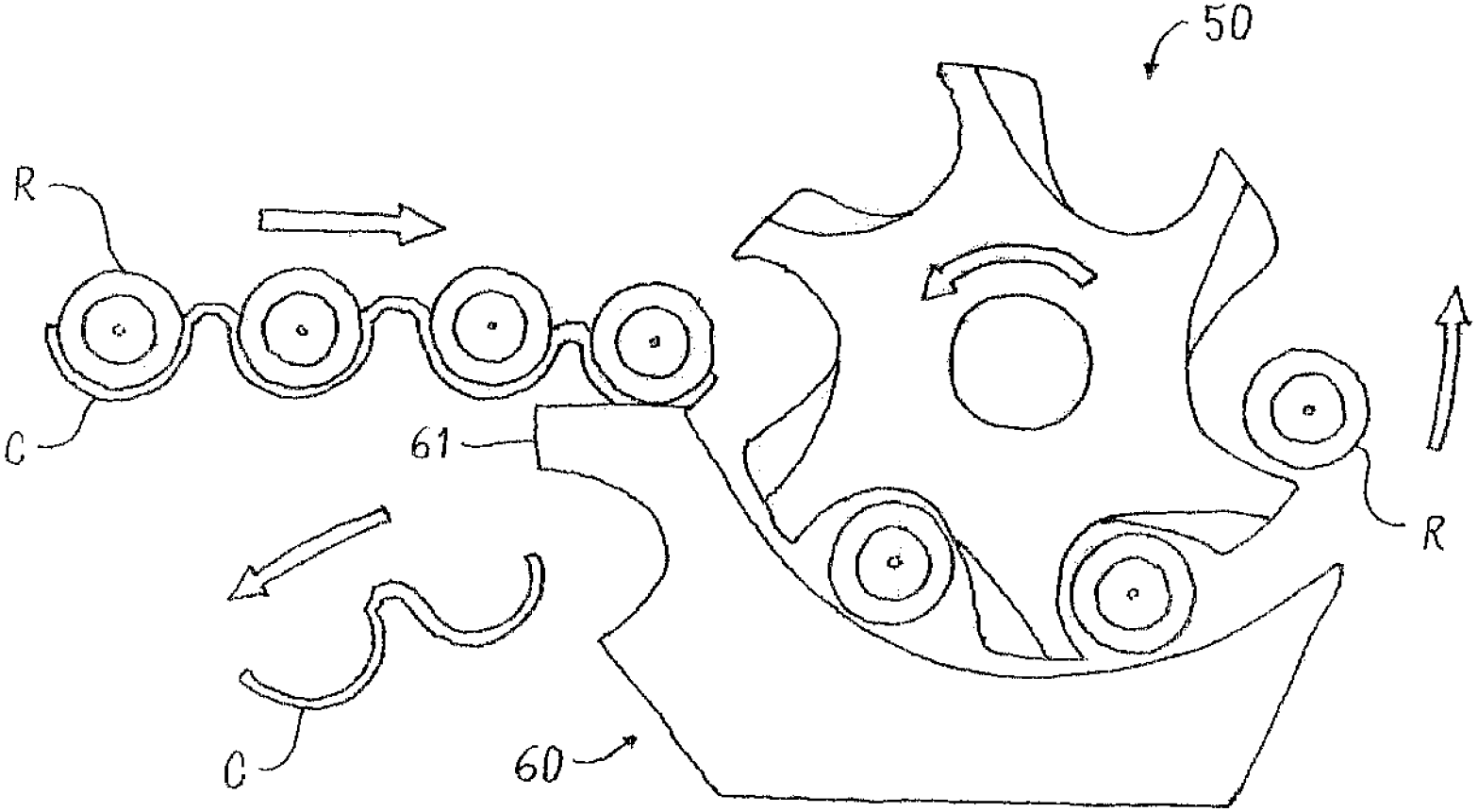
FIG. 14 is a detailed sectional view.

The operation of the feeder-delinker can now be considered in detail. Referring now to FIG. 14, an ammunition belt consisting of multiple rounds and multiple clips is inserted into the feeder delinker. The leading clip drops into the recess of the shelf of the lower stripper while the leading round remains on top of the shelf. When the gun is fired, the rotor gear of the gun turns the driven spur gear of the primary rotatable shaft assembly. The turning of the primary shaft causes the secondary shaft assembly to rotate.

The leading edge of a paddle of the paddlewheel restrains the leading clip in the recess of the shelf of the lower stripper, the trailing block contacts the leading round between the two coaxial C-shaped loops, and then strips the leading round away from the clip. The separated round is then conveyed along the curved surface of the lower stripper, along the front and rear cams of the upper stripper, and then up into the rotary firing chamber of the gun. Simultaneously, the released clip is discharged through the slot and out of the feeder delinker. The turning of the feed sprockets on the secondary shaft causes the ammunition belt to feed more rounds and clips into the feeder delinker. The process continues as long as the gun is fired.

9. Advantages

Compared to prior feeder delinkers for Gatling-type machine guns, the feeder delinker of this invention has many advantages. It has fewer total parts. It has fewer moving parts (only the paddlewheel, sprockets, gears, and shafts move). It is smaller and lighter in weight. It is more reliable. It is more durable. It is less expensive to manufacture. It is easier to maintain because of greater accessibility. It is easier to disassemble. It is easier to time (to position the initial round and clip before operation).

I claim:

1. A feeder delinker for accepting an ammunition belt consisting of interconnecting rounds and clips, separating the leading round from the leading clip, and feeding the separated rounds to a machine gun having multiple rotating barrels that fire sequentially and having a rotary firing chamber and a drive gear, the feeder delinker comprising:

(a) a housing having: (i) a bracket for attachment to the machine gun; (ii) a primary sleeve for accepting a primary rotatable shaft; (iii) a secondary sleeve for accepting a secondary rotatable shaft; (iv) an inlet for accepting an ammunition belt consisting of interconnecting rounds and clips; (v) a first outlet for separated rounds adapted to communicate with a rotary firing chamber of the machine gun; and (vi) a second outlet for separated clips;

(b) a primary rotatable shaft assembly in the primary sleeve of the housing, the primary shaft assembly having: (i) a primary rotatable shaft; (ii) a driven spur gear on the primary shaft engaging the drive gear of the machine gun; and (iii) a timing spur gear on the primary shaft;

(c) a secondary rotatable shaft assembly in the secondary sleeve of the housing, the secondary shaft assembly having: (i) a secondary rotatable shaft; (ii) a driven spur gear on the secondary shaft engaging the timing spur gear of the primary shaft; (iii) a front sprocket on the secondary shaft that engages the front of the leading round in an ammunition belt; and (iv) a rear sprocket on the secondary shaft that engages the rear of the leading round in an ammunition belt;

(d) a paddlewheel mounted on the secondary rotatable shaft, the paddlewheel having a plurality of radial paddles for applying a side force to the leading round in the ammunition belt sufficient to strip the round from the restrained clip, each paddle having a leading outer edge for engaging the leading clip and having a trailing block for engaging the leading round;

(e) a lower stripper having: (i) a shelf for supporting and restraining the leading round and the leading clip in the ammunition belt; (ii) a curved surface coaxial with the secondary rotatable shaft for guiding the separated round; and (iii) a slot communicating with the second outlet of the housing for the discharge of the separated clip; and (f) an upper stripper having: (i) a bracket overhanging the shelf of the lower stripper; (ii) a front cam connected to the bracket for guiding the front of the separated round; and (iii) a rear cam connected to the bracket for guiding the rear of the separated round;

such that in operation with the machine gun, each radial paddle strips the leading round from the leading clip and then transports the separated round to the first outlet.

2. The feeder delinker of claim 1 wherein the trailing blocks of the paddlewheel are narrower than the leading outer edges of the paddlewheel.

3. A feeder delinker for accepting an ammunition belt consisting of interconnecting rounds and clips, separating the leading round from the leading clip having two spaced apart coaxial C-shaped loops, and feeding the separated rounds to a machine gun having multiple rotating barrels that fire sequentially and having a rotary firing chamber and a drive gear, the feeder delinker comprising a rotating paddlewheel having a plurality of radial paddles for applying a side force to the leading round in the ammunition belt sufficient to strip the round from the restrained clip, each paddle having a leading outer edge for engaging the leading clip and having a trailing block for engaging the leading round between the two C-shaped loops.

4. The feeder delinker of claim 3 wherein the trailing blocks of the paddlewheel are narrower than the leading outer edges of the paddlewheel.

* * * * *